United States Patent [19]

Ortiz

[11] Patent Number: 4,574,476

[45] Date of Patent: Mar. 11, 1986

[54] RAZOR BLADE ASSEMBLY

[75] Inventor: Ernest A. Ortiz, Cheshire, Conn.

[73] Assignee: Warner-Lambert Company, Morris Plains, N.J.

[21] Appl. No.: 701,330

[22] Filed: Feb. 13, 1985

Related U.S. Application Data

[63] Continuation of Ser. No. 424,813, Sep. 27, 1982, abandoned.

[51] Int. Cl.[4] ..... B26B 21/22

[52] U.S. Cl. ..... 30/47; 30/50; 30/57

[58] Field of Search ..... 30/47, 52, 50, 68, 83, 30/57

[56] References Cited

U.S. PATENT DOCUMENTS

| | | | |
|---|---|---|---|
| 3,890,704 | 6/1975 | Ferraro | 30/50 X |
| 4,324,041 | 4/1982 | Trotta | 30/50 X |
| 4,403,413 | 9/1983 | Trotta | 30/50 X |
| 4,443,939 | 4/1984 | Motta et al. | 30/50 X |

*Primary Examiner*—E. R. Kazenske
*Assistant Examiner*—Willmon Fridie, Jr.
*Attorney, Agent, or Firm*—R. S. Strickler

[57] ABSTRACT

A razor blade assembly including two blades in which the blades are secured to a hinge arrangement which serves dually as a blade spacer and as a hinge individual to each blade.

2 Claims, 5 Drawing Figures

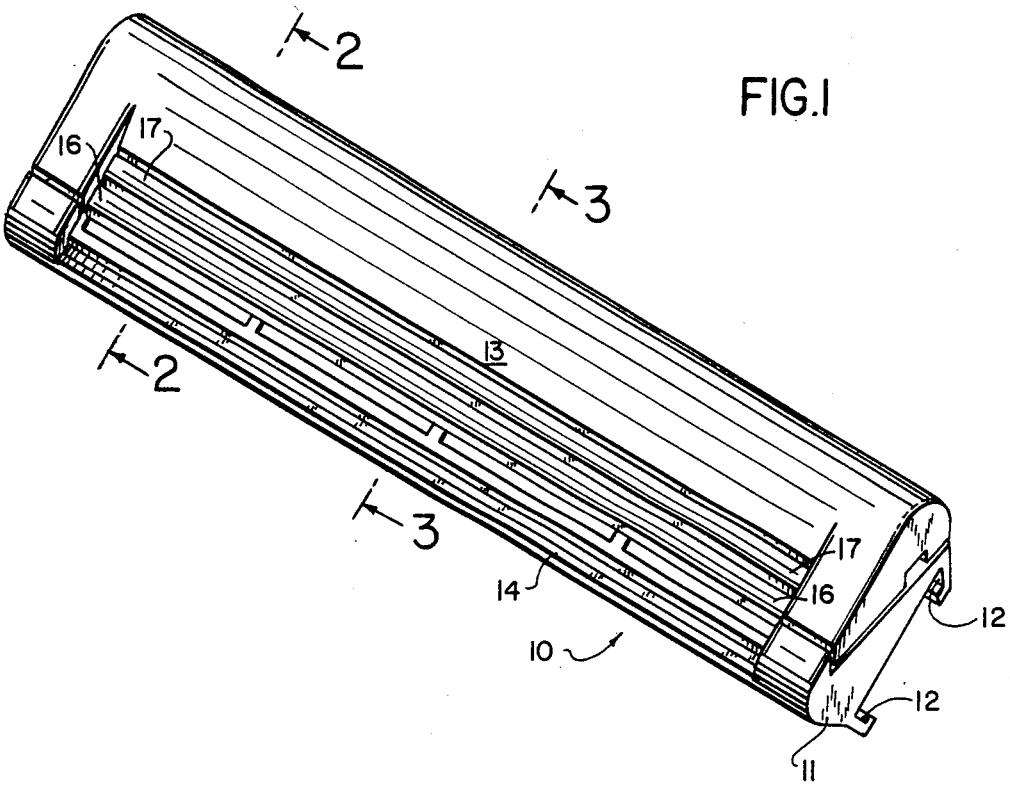
FIG.1
FIG.2
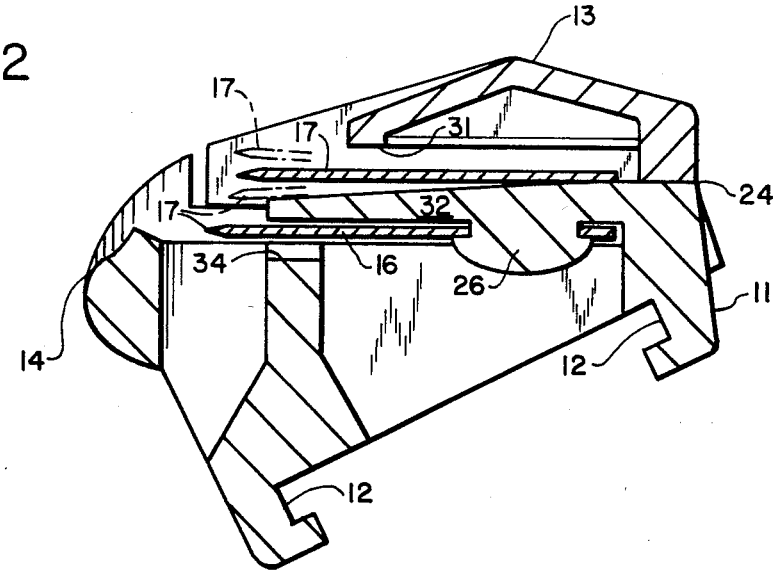

RAZOR BLADE ASSEMBLY

This is a continuation of application Ser. No. 424,813 filed Sept. 27, 1982, now abandoned.

BACKGROUND OF THE INVENTION

The present invention deals with wet shaving and relates in particular to a wet shaving razor assembly including two blades each having a single cutting edge.

Razor blades of this class are usually offset or spaced from one another by a generally flat element termed a "spacer".

The cutting edges of the blades are also offset from one another so as to develop in combination with the spacer and other elements of the razor body a fixed "blade geometry" which insures optimum shaving efficiency, comfort and safety.

The language "blade geometry" is intended to denote an optimum setting or spacing of blades and blade edges relative to other elements of the razor such as the guard bar and blade cap.

Recently it has been determined that it is desirable to devise a razor blade assembly which is more or less free to develop a "variable" blade geometry where the geometry varies in response to shaving forces, the contours and texture of the skin surface shaved, the toughness of the beard, or any combination or permutation of the above factors.

FIELD OF THE INVENTION

It is a particular feature of the invention to provide a blade assembly in which two blades are spaced apart and supported by a member which permits relative motion between the blades allowing blade geometry to change during the course of shaving.

A further feature of the invention is the provision of a segmented spacer element hinged to the body of a razor where a first blade is secured to a first group of spacer segments and a second blade is secured to a second group of spacer segments and all spacer segments are sandwiched between the first and second blades, thereby permitting the blades to pivot relative to one another and relative to other elements of the razor body.

DESCRIPTION OF THE PRIOR ART

The most pertinent prior art razor device over which the present invention is an improvement is shown and described in U.S. Pat. No. 4,324,041 issued Apr. 13, 1982, to Robert A. Trotta entitled RAZOR BLADE ASSEMBLY and assigned on its face to The Gillette Company.

The U.S. Pat. No. 4,324,041 shows a "spacerless" blade assembly where a first blade 28 is supported near its cutting edge by flexible arms 24 and a second blade 30 is supported by flexible arms 26. The set of arms 26 is received within perforations formed in the first blade 28, and the rear ends of both blades 28 and 30 are snubbed or socketed frictionally in pockets 66 and 68 respectively.

SUMMARY OF THE INVENTION

A wet shaving device embracing certain important features of the present invention may comprise at least two single edge blades, a support element including a guard bar, a plurality of spacer segments or fins hinged to the support element, said fins being grouped to define a first set of fins being the sole support for a first blade and a second set of fins being the sole support for a second blade, the disposition of the blades relative to the fins being such that all fins act collectively to space the first blade from the second blade.

Other features and advantages of the present invention will become more apparent from an examination of the succeeding specification when read in conjunction with the appended drawings, in which:

BRIEF DESCRIPTION OF THE DRAWINGS

FIG. 1 is a perspective view of a razor blade assembly embodying the principles of the present invention;

FIG. 2 is a vertical section of the assembly of FIG. 1 in the plane denoted by the line 2—2 in FIG. 1 as viewed in the direction of the arrows showing a first blade secured (riveted) to a spacer segment of a first set of segments and a second blade merely overlaying said spacer segment with no fixed connection to said segment;

DESCRIPTION OF THE PREFERRED EMBODIMENT

Figure 3:
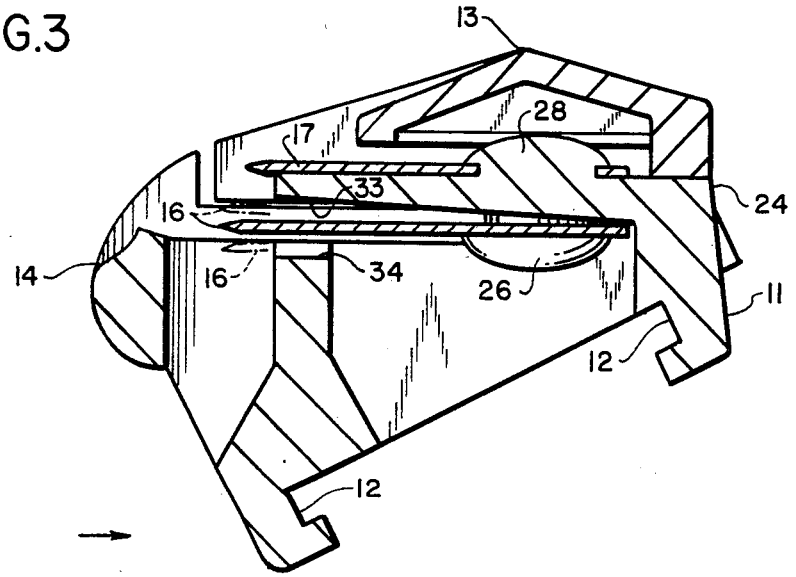
FIG. 3 is a vertical section of FIG. 1 in the plane represented by the line 3—3 as viewed in the direction of the arrows showing the second blade riveted to a spacer segment of a second set of segments with no fixed connection between the first blade and said segment.
Figure 4:
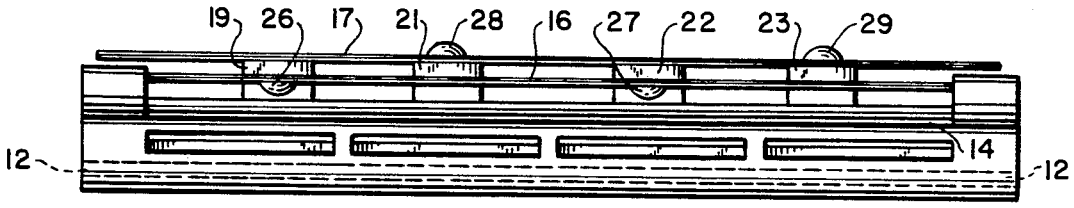
FIG. 4 shows a front view of the blade assembly of FIG. 1 with the cap removed.

Referring now to the drawings, FIG. 1 shows a razor blade assembly identified by the reference numeral 10 having a body 11, a track 12, cap 13, guard bar 14, first blade 16 and second blade 17.

Figure 5:
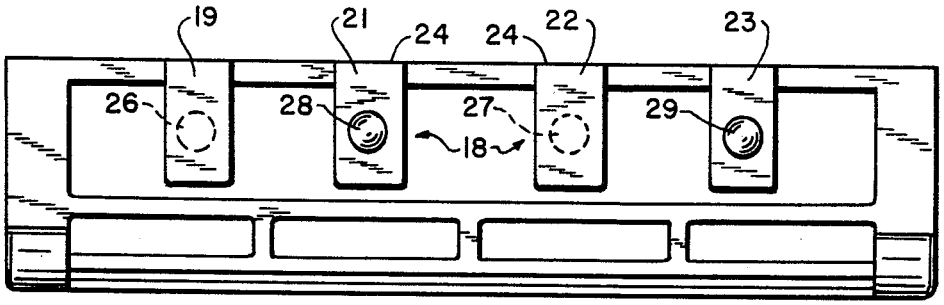
FIG. 5 is a top plan view of the razor body with the cap and blades removed to show the structure of the segmental spacer and its hinged connection to the razor body.

As is most apparent in FIGS. 2, 3 and 5, the body 11 supports a segmented spacer means 18 comprising spacer segments 19, 21, 22 and 23 hinged to the body 11 as at 24.

Spacer segments 19 and 22 define a first set of spacer segments and segments 21 and 23 define a second set of spacer segments.

Each spacer segment is a fin-like structure and all segments are generally coplanar in the normal or unstressed condition. That is, the top and bottom surfaces of the spacer segments lie within parallel planes spaced apart a distance generally equal to the thickness of the spacer means.

Since all elements of the razor (except the blades) are molded of plastic material, the molding material is selected and the design of the spacer segments adjusted to insure flexibility of the segments with sufficient elastic memory to assume a generally coplanar relationship normally.

Alternate segments 19 and 22 defining the first set are formed with downwardly projecting rivets 26 and 27 extending from the bottom side of segments 19 and 22 while intervening segments 21 and 23, the second set, are formed with upwardly projecting rivets 28 and 29 extending from the top side of segments 21 and 23.

Referring in detail to FIGS. 2, 3 and 5, it is apparent that the first blade 16 is secured to the first set of spacer segments 19 and 22 by means of rivets 26 and 27 respectively, while the second blade 17 is secured to the second set of spacer segments 21 and 23 by means of rivets 28 and 29.

Thus the first blade 16 is hinged to razor body 11 by the first set of spacer segments 19 and 22 and the second blade 17 is so hinged by the second set of segments 21 and 23.

It is to be understood that the number of segments in each set is a mere matter of choice and there may be one or more segments in each set as consideration of design, plastic materials and desired flexibility dictate.

With the blades mounted as described above, it is apparent (see FIG. 3) that the first blade 16 is normally in the solid line position but is free to pivot about the razor body 11 through an arc represented by the dotted line positions of blade 16 in response to shaving forces.

Correspondingly, the second blade 17 is free to pivot (see FIG. 2) from its normal or solid line position through an arc represented by the dotted line positions of the blade 17 in response to shaving forces.

Thus both blades are free to pivot independently from their normal positions to develop variable or changing blade geometry in response to shaving forces where the scope of pivoting is limited by the stops 33 and 34 in the case of the first blade 16 (FIG. 3) and by the stops 31 and 32 in the case of the second blade 17 (FIG. 2).

It is anticipated that a wide variety of modifications, such as variations in numbers of segments within each set of spacer segments and variations in the method means for mounting blades of various width, can be devised without departing from the spirit and scope of this invention.

What is claimed is:

1. A wet shaving device having at least two single edge blades comprising a support element including a guard bar, a segmented flat blade spacer means hinged to the support element, said spacer means being grouped to define a first set of flat spacer segments and a second set of flat spacer segments, the spacer segments of the first set being disposed alternately with respect to the spacer segments of the second set, each spacer segment having a top side and a bottom side, a first blade fixed to the top side of the first set of flat spacer segments and a second blade fixed to the bottom side of the second set of spacer segments so that the first set of flat spacer segments and the first blade are free to pivot as a unit independently of the unit defined by the second set of spacer segments and the second blade.

2. A wet shaving device having at least two single edge blades comprising a support element including a guard bar, a segmented flat blade spacer means hinged to the support element, said spacer means being grouped to define a first set of flat spacer segments and a second set of flat spacer segments, the spacer segments of the first set being disposed alternately with respect to the spacer segments of the second set, each spacer segment having a top side and a bottom side, a first blade fixed to the top side of the first set of flat spacer segments and a second blade fixed to the bottom side of the second set of spacer segments so that the first set of flat spacer segments and the first blade are free to pivot as a unit independently of the unit defined by the second set of spacer segments and the second blade, the pivoting of each blade-spacer unit being limited by stops.

* * * * *